US012251038B2

(12) United States Patent
Park

(10) Patent No.: US 12,251,038 B2
(45) Date of Patent: Mar. 18, 2025

(54) APPARATUS FOR ASSISTING SLEEP

(71) Applicant: Corelabs International Co., Ltd., Seoul (KR)

(72) Inventor: Sangeun Park, Seoul (KR)

(73) Assignee: CORELABS INTERNATIONAL CO., LTD., Seoul (KR)

( * ) Notice: Subject to any disclaimer, the term of this patent is extended or adjusted under 35 U.S.C. 154(b) by 27 days.

(21) Appl. No.: 18/089,332

(22) Filed: Dec. 27, 2022

(65) Prior Publication Data

US 2023/0225526 A1 Jul. 20, 2023

(30) Foreign Application Priority Data

Jan. 14, 2022 (KR) ..... 10-2022-0005620

(51) Int. Cl.
*A47G 9/10* (2006.01)

(52) U.S. Cl.
CPC ..... *A47G 9/1009* (2013.01)

(58) Field of Classification Search
CPC ..... A47G 9/1009; A47G 9/1081; A47G 2009/1018; A47G 9/109; A47G 9/1045; A47G 9/1063; A61G 13/121
USPC ..... 5/633, 636, 733
See application file for complete search history.

(56) References Cited

U.S. PATENT DOCUMENTS 5,033,137 A * 7/1991 Pedrow ..... A61H 1/008 5/636
5,987,675 A * 11/1999 Kim ..... A61F 5/05883 5/636
7,082,633 B1 * 8/2006 Maarbjerg ..... A47G 9/10 5/636
8,496,007 B2 * 7/2013 Rambo ..... A61H 7/001 601/134
8,931,837 B2 * 1/2015 Vernon ..... A47C 7/46 297/452.32
11,160,397 B2 11/2021 Zurek
2006/0272095 A1 * 12/2006 Kornaker ..... A61H 31/008 5/632
2013/0198953 A1 * 8/2013 Long ..... A63B 23/0216 5/417
2019/0262162 A1 * 8/2019 Yoo ..... A61H 1/008
2020/0155396 A1 * 5/2020 Popitz ..... A47G 9/10
2023/0329462 A1 * 10/2023 Davis ..... A47G 9/1009

FOREIGN PATENT DOCUMENTS

KR 101590068 B1 1/2016
KR 101707336 B1 2/2017

* cited by examiner

*Primary Examiner* — Myles A Throop
(74) *Attorney, Agent, or Firm* — Umberg Zipser LLP

(57) ABSTRACT

An apparatus for assisting sleep is provided that includes a body, a central groove formed in a center of the body and extending in a first direction, and a plurality of accommodation grooves formed in a symmetrical shape with respect to the central groove and arranged in a second direction perpendicular to the first direction, in which the plurality of accommodation grooves is disposed closer to an upper end of the body than a lower end of the body.

8 Claims, 15 Drawing Sheets

APPARATUS FOR ASSISTING SLEEP

CROSS-REFERENCE TO RELATED APPLICATIONS

This application claims priority to and the benefit of Korean Patent Application No. 10-2022-0005620 filed in the Korean Intellectual Property Office on Jan. 14, 2022, the entire contents of which are incorporated herein by reference.

TECHNICAL FIELD

The present disclosure relates to an apparatus for assisting sleep, and more particularly, to a new concept of device for assisting sleep which is capable of reducing pain in the neck, back, shoulder, etc., while sleeping.

BACKGROUND ART

In general, a posture in which the neck and shoulder bend forward and the back muscles relax (e.g., turtle neck) causes pain in the neck, back, and shoulder, and when this posture lasts, pain in the neck and waist muscles or disc disease may be caused.

When the conventional pillow is used while sleeping, the turtle neck syndrome may occur, thereby causing the neck pain, shoulder pain, headache, and other pains. In addition, in the case of sleeping on side using the conventional pillow, pain in the shoulder blades and muscles therearound may be caused by a pressure on the shoulder.

The conventional functional pillow products may cause more pain by the above-described problems. Moreover, lying down on the back and facing the ceiling, may give a good feeling, but may actually cause more discomfort while sleeping. This is because people do not maintain a posture of lying on the back and facing the ceiling, but toss and turn at regular intervals, and sometimes lie on the side.

Therefore, there is an increasing need to develop a new type of device for assisting sleep to solve the above-described problems of the conventional pillow products.

The present disclosure is invented from these technical backgrounds to not only satisfy the technical requirements described above, but also provide additional technical factors which cannot be easily invented by those skilled in the art.

SUMMARY OF THE INVENTION

The present disclosure has been made in an effort to provide a new concept of device for assisting sleep as a technical solution which is capable of reducing pain in the neck, back, and shoulder while sleeping.

For example, the present disclosure has been made in an effort to provide an apparatus for assisting sleep which is capable of relaxing muscles overused during the daytime and contracting stretched muscles into a comfortable state. In addition, the present disclosure has been made in an effort to provide an apparatus for assisting sleep which prevents a shoulder pressing symptom or a neck clenching symptom caused by the pillow when a user moves and lies on his/her side while sleeping.

Meanwhile, the technical solutions to be achieved by the present disclosure are not limited to the technical solutions described above, and various technical solutions may be included within a range obvious to those skilled in the art from the following description.

According to an embodiment of the present disclosure to achieve the above-mentioned technical solutions, an apparatus for assisting sleep may include: a body; a central groove formed in a center of the body and extending in a first direction; and a plurality of accommodation grooves formed in a symmetrical shape with respect to the central groove and arranged in a second direction perpendicular to the first direction.

According to the embodiment of the present disclosure, the plurality of accommodation grooves may be disposed closer to an upper end of the body than a lower end of the body.

According to the embodiment of the present disclosure, the central groove may be formed in a shape which is capable of accommodating a spine therein, and the plurality of accommodation grooves may each be formed in a shape capable of accommodating a shoulder therein.

According to the embodiment of the present disclosure the apparatus for assisting sleep may further include: a fixing unit formed around the plurality of accommodation grooves or the lower end of the body and configured to fix a human body.

According to the embodiment of the present disclosure, a length of the body along the first direction may correspond to an average length between an occipital portion and a twelfth rib of an adult.

According to the embodiment of the present disclosure, the body may have inclinations which are decreased in height at the upper end and the lower end of the body, respectively, and the inclination of the lower end of the body may be less than the inclination of the upper end of the body.

According to the embodiment of the present disclosure, the plurality of accommodation grooves may include a first accommodation groove configured to accommodate one shoulder of the human body therein; and a second accommodation groove configured to accommodate the other shoulder of the human body therein, in which the apparatus may further include: a first-first wing portion formed on a upper portion of the first accommodation groove; a first-second wing portion formed in a lower portion of the first accommodation groove; a second-first wing portion formed in a upper portion of the second accommodation groove; and a second-second wing portion formed in a lower portion of the second accommodation groove.

According to the embodiment of the present disclosure, the first-first wing portion may include a narrower region than the first-second wing portion, the second-first wing portion may include a narrower region than the second-second wing portion, the first-first wing portion may be formed in a symmetrical shape with the second-first wing portion with respect to the central groove, and the first-second wing portion may be formed in a symmetrical shape with the second-second wing portion with respect to the central groove.

Meanwhile, an apparatus for correcting a posture according to an embodiment of the present disclosure for achieving various technical solutions including the above-described technical solutions, may include: a body; a central groove formed in a center of the body and configured to accommodate at least a part of a spine therein; a plurality of accommodation grooves formed in a symmetrical shape with respect to the central groove and configured to accommodate both shoulders therein; and a fixing unit formed around the plurality of accommodation grooves or a lower end of the body and configured to fix a human body.

According to an embodiment of the present disclosure, it is possible to provide the apparatus for assisting sleep which is capable of relaxing muscles overused during the daytime and contracting stretched muscles. For example, according to an embodiment of the present disclosure, it is possible to provide the apparatus for assisting sleep which is capable of relaxing the trapezius muscle of the shoulder and contracting core muscles of the neck and back, the dorsal muscle, muscles between the shoulder blades, and the like when lying down facing the ceiling straight up.

According to an embodiment of the present disclosure, it is possible to provide the apparatus for assisting sleep which is capable of relieving pain by preventing the shoulder compressing symptom or the neck clenching symptom caused by the pillow when a user moves and lies on his/her side while sleeping.

According to an embodiment of the present disclosure, it is possible to provide the apparatus for assisting sleep which is capable of preventing a desired body support portion of the apparatus for assisting sleep from being misaligned with an actual body support portion caused by moving while sleeping.

According to an embodiment of the present disclosure, it is possible to provide the apparatus for assisting sleep which is capable of solving a problem related to the waist pain that may occur during the process of supporting a back site.

Meanwhile, the effects of the present disclosure are not limited to the above-mentioned effects, and various effects may be included within a range obvious to those skilled in the art from the following description.

DETAILED DESCRIPTION

Figure 1:
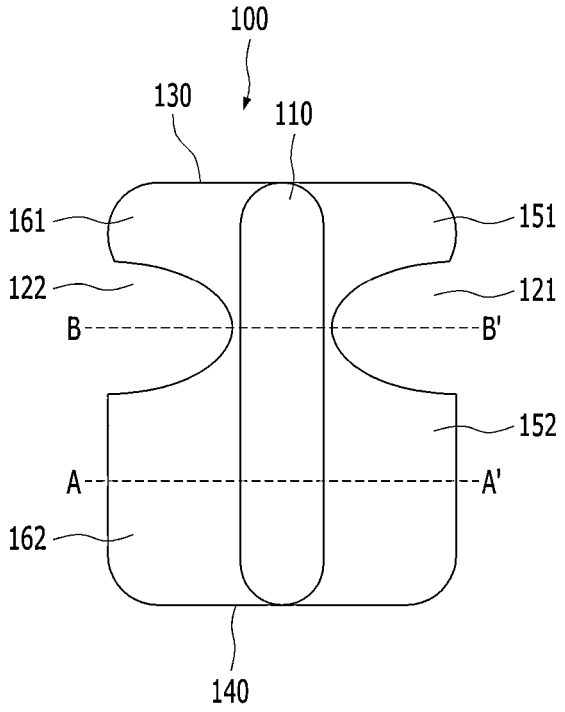
FIG. 1 is a top plan view illustrating an apparatus for assisting sleep according to an embodiment of the present disclosure.

Hereinafter, with reference to the accompanying drawings, an apparatus for assisting sleep according to the present disclosure will be described in detail. The embodiments described are provided so that the technical spirits of the present disclosure can be easily understood by those skilled in the art, but the present disclosure is not limited thereby. In addition, the configurations illustrated in the accompanying drawings is in a schematic form for easily explaining the embodiments of the present disclosure, but it may differ from the configurations actually implemented.

Meanwhile, each constituent element described below is just illustrative for implementing the present disclosure. Therefore, different constituent elements may be used in other embodiments of the present disclosure within a range without departing from the spirit and scope of the present disclosure.

The expression "comprise/include" and variations such as "comprises/includes" or "comprising/including" will be understood as open-ended terms to just imply the inclusion of stated elements, not the exclusion of any other elements.

An apparatus for assisting sleep according to an embodiment of the present disclosure may include various products that can be used to support a human body or physically correct a posture. For example, various products referred to as pillows, cushions, mattresses, and the like may be included, and in addition to these examples, various products that can support a human body or physically correct a posture may be included.

According to the apparatus for assisting sleep in accordance with an embodiment of the present disclosure, it is possible to relax the trapezius muscle of the shoulder and contract core muscles of the neck and back, the dorsal muscle, muscles between shoulder blades, and the like when lying down facing a ceiling straight up.

The apparatus for assisting sleep according to an embodiment of the present disclosure may include a structure that focuses on supporting the shoulders and back, departing from the paradigm of the conventional device for assisting sleep (e.g., pillow) that focuses on supporting the neck and head. For example, the apparatus for assisting sleep according to an embodiment of the present disclosure may provide a function for assisting sleep on the basis of a structure including: a body; a central groove formed in a center of the body and configured to accommodate at least a part of a spine therein; a plurality of accommodation grooves formed in a symmetrical shape with respect to the central groove and configured to accommodate both shoulders therein.

According to the apparatus for assisting sleep in accordance with an embodiment of the present disclosure, it is possible to relieve pain by preventing a shoulder compressing symptom or a neck clenching symptom caused by the pillow when a user moves and lies on his/her side while sleeping. For example, according to the apparatus for assisting sleep of the present disclosure, it is possible to prevent a shoulder compressing symptom or a neck clenching symptom on the basis of wing structures formed on an upper or lower portion of the plurality of accommodation grooves, as an upper part of the shoulder (head part) or a lower part of the shoulder (arm, flank part, etc.) supports a human body in a comfortable posture when a posture of a user is sleeping on his/her side.

According to the apparatus for assisting sleep in accordance with an embodiment of the present disclosure, it is possible to prevent a desired body support portion of the apparatus for assisting sleep from being misaligned with an actual body support portion caused by moving while sleeping. For example, the apparatus for assisting sleep according to an embodiment of the present disclosure may be fixed to the user (e.g., the user may wear the apparatus in the same form as wearing a bag) on the basis of a fixing unit formed around a lower end of the body or the plurality of accommodation grooves, thereby preventing a desired body support portion of the apparatus for assisting sleep from being misaligned with an actual body support portion caused by moving while sleeping.

According to an embodiment of the present disclosure, it is possible to provide the apparatus for assisting sleep which is capable of solving a problem related to a waist pain that may occur during the process of supporting a back site. For example, in the apparatus for assisting sleep according to an embodiment of the present disclosure, a length of the body of the apparatus may be configured so that a dorsal corresponding portion of a twelfth rib is located in the lower end of the body of the apparatus and an inclination of the lower end of the body may be less than an inclination of an upper end of the body, thereby solving a problem related to the waist pain that may occur during the process of supporting a back site.

Hereinafter, referring to FIGS. 1 to 4, an apparatus for assisting sleep 100 according to an embodiment of the present disclosure will be described.

Referring to FIG. 1, an apparatus for assisting sleep 100 according to an embodiment of the present disclosure may include: a body; a central groove 110 formed in a center of the body and extending in a first direction; and a plurality of accommodation grooves 121 and 122 formed in a symmetrical shape with respect to the central groove and arranged in a second direction perpendicular to the first direction. In this case, the plurality of accommodation grooves 121 and 122 may be disposed closer to an upper end 130 of the body than a lower end 140 of the body so that both shoulders of a user may be accommodated therein. In addition, the body of the apparatus for assisting sleep 100 may be formed of various materials. For example, the body may be formed of a material having a high hardness or a material having a low hardness such as memory foam, and may be formed of various materials in addition to these materials.

The center groove 110 may be formed in the center of the body of the apparatus for assisting sleep 100 and extending in the first direction to accommodate the user's spinal portion therein. In this case, the first direction may preferably be parallel to a direction connecting a center of the upper end 130 of the apparatus for assisting sleep 100 and a center of the lower end 140 thereof.

Figure 2:
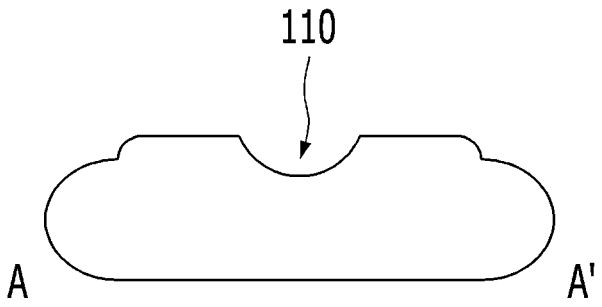
FIG. 2 is a cross-sectional view illustrating a cross-section A of the apparatus for assisting sleep according to the embodiment of the present disclosure.

The central groove 110 may be configured in a shape which is capable of accommodating the spine therein. For example, the center groove 110 may be formed in a shape that elongates in the first direction in a top plan view, and may include a groove of depth corresponding to an average height at which the spine protrudes from the skin anatomically, and may be formed to have a surface area corresponding to an average area of the spine and surrounding tissues. Meanwhile, an exemplary shape of the center groove 110 is illustrated in FIGS. 1 and 2. For example, the center groove 110 may be formed in a shape of an elongated column in a top plan view as illustrated in FIG. 1, may be formed to have a width to accommodate the spine and surrounding tissues therein, and may be formed in a groove of depth corresponding to a protruding height of the spine as illustrated in FIG. 2.

The central groove 110 may accommodate the user's spinal portion therein, thereby preventing an uncomfortable pressure from being applied to the spinal portion while sleeping. In addition, in this case, portions of the body of the apparatus for assisting sleep 100 disposed around the central groove 110 (i.e., among the portions of the body, portions disposed around the center groove 110 and not grooved), may serve to support the erector muscle of the spine in a state that the spine is accommodated in the central groove 110. For example, as illustrated in FIG. 2, flat structures formed on both sides of the central groove 110 may serve to support the erector muscle of the spine.

The plurality of accommodation grooves 121 and 122 are formed in a symmetrical shape with respect to the center groove 110 to accommodate both shoulders of the user therein. The plurality of accommodation grooves 121 and 122 are arranged in a second direction perpendicular to the first direction.

The plurality of accommodation grooves 121 and 122 may be disposed in a shape that is closer to the upper end 130 of the body than the lower end 140 of the body, and may be configured in a shape which is capable of accommodating both shoulders of the user therein. Specifically, the plurality of accommodation grooves 121 and 122 may be formed in an ergonomic groove shape corresponding to a standard protrusion shape of the shoulder (e.g., an average protrusion shape of the shoulder obtained on the basis of statistical human body information), and may be formed in various shapes which is capable of accommodating the shoulders therein in addition to the aforementioned shapes. For example, each of the plurality of accommodation grooves 121 and 122 may be formed in various shapes including straight lines or curves, in a top plan view, or may be formed in an irregular shape having an area which is capable of accommodating the shoulders therein.

Figure 3:
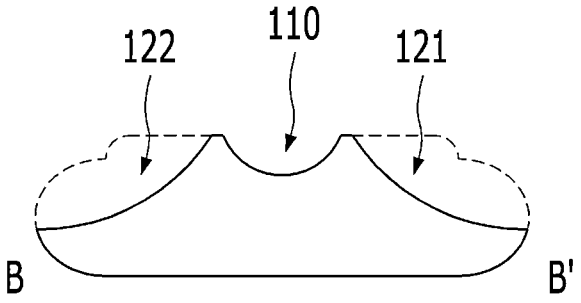
FIG. 3 is a cross-sectional view illustrating a cross-section B of the apparatus for assisting sleep according to the embodiment of the present disclosure.

Each of the plurality of accommodation grooves 121 and 122 may include a groove shape whose depth changes gently in consideration of the protrusion height of the shoulders and surrounding bones as illustrated in FIG. 3. This is because the gradual changing depth in a cross-sectional view may make the apparatus for assisting sleep to more comfortably accommodate and support the user's shoulders.

The plurality of accommodation grooves 121 and 122 may allow the shoulders of the human body to be accommodated therein and pulled backwards, thereby extending the bent shoulders and contracting the hyper extended back muscles and resulting in reducing back muscle pain while sleeping and creating a good spinal posture.

Meanwhile, as illustrated in FIG. 1, the plurality of accommodation grooves 121 and 122 may include: a first accommodation groove 121 configured to accommodate one shoulder of the human body therein; and a second accommodation groove 122 configured to accommodate the other shoulder of the human body therein, in which the apparatus for assisting sleep 100 may further include: a first-first wing portion 151 formed on a upper portion of the first accommodation groove 121; a first-second wing portion 152 formed in a lower portion of the first accommodation groove 121; a second-first wing portion 161 formed in a upper portion of the second accommodation groove 122; and a second-second wing portion 162 formed in a lower portion of the second accommodation groove 122.

In this case, the first-first wing portion 151, the first-second wing portion 152, the second-first wing portion 161, and the second-second wing portion 162 may relieve pain by preventing a shoulder pressing symptom or a neck clenching symptom by the pillow when a user moves and lies on his/her side while sleeping. For example, the first-first wing portion 151 and the second-first wing portion 161 may alleviate symptoms in that the user's neck is clenching or a body weight is pulled toward the shoulder by comfortably supporting a lateral surface of the user's head or a lateral surface of the user's face when a posture of a user is sleeping on his/her side. In addition, the first-second wing portion 152 and the second-second wing portion 162 may alleviate the symptom in that the user's body weight is pulled toward the shoulder by supporting the user's flank or arm when the user makes the posture of sleeping on his/her side.

As illustrated in FIG. 1, the first-first wing portion 151 may be configured in a shape that includes a narrower region than the first-second wing portion 152, and the second-first wing portion 161 may be configured in a shape that includes a narrower region than the second-second wing portion 162 as illustrated in FIG. 1. Since the first-first wing portion 151 and the second-first wing portion 161 may perform a function of supporting a narrower body region (e.g., the lateral surface of the head, the lateral surface of the face) than the first-second wing portion 152 and the second-second wing portion 162, the first-first wing portion 151 and the second-first wing portion 161 may have the narrower region in consideration of anatomical characteristics.

The first-first wing portion 151 may be formed in a symmetrical shape with the second-first wing portion 161 with respect to the central groove, and the first-second wing portion 152 may be formed in a symmetrical shape with the second-second wing portion 162 with respect to the central groove. This is because this symmetrical structure may allow the same support function to be performed regardless of the direction in which the user lies on his/her side.

As illustrated in FIG. 2, the first-first wing portion 151, the first-second wing portion 152, the second-first wing portion 161, and the second-second wing portion 162, respectively, may have an inclination that gradually decreases in height toward the end. This inclined structure allows the user to more comfortably support the head, face, flank, arm, etc., when the posture of the user is sleeping on his/her side.

Meanwhile, the body of the apparatus for assisting sleep 100 according to an embodiment of the present disclosure may have a length thereof corresponding to an average length between an occipital portion (the back and lower portion of the head) and a twelfth rib of an adult along the first direction. With this structure, the lower end 140 of the body of the apparatus for assisting sleep 100 may support the dorsal corresponding portion of the twelfth rib, thereby preventing the waist pain that may occur in the process of supporting a back side. (For reference, when the lower end 140 of the body supports a position lower than a position of the twelfth rib, the waist muscles are pressed to create a curve, which may cause the back pain.)

Figure 4:
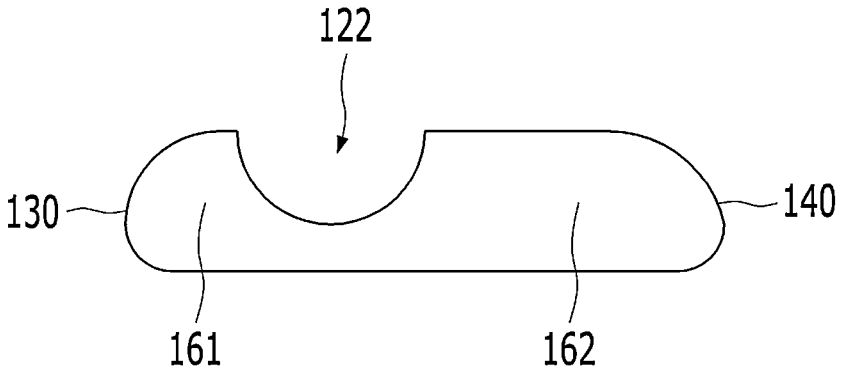
FIG. 4 is a side view illustrating the apparatus for assisting sleep according to the embodiment of the present disclosure.

The body of the apparatus for assisting sleep 100 may have an inclination that decreases in height in each of the upper end 130 of the body and the lower end 140 of the body, as illustrated in FIG. 4. This is because the above-mentioned structure may allow the upper end 130 of the body to ergonomically and more comfortably support the occipital portion of the user and allow the lower end 140 of the body to ergonomically and more comfortably support a portion around the user's waist.

The body of the apparatus for assisting sleep 100 may be configured so that the inclination of the lower end 140 of the body is gentler than the inclination of the upper end 130 of the body, as illustrated in FIG. 4. The upper end 130 of the body may comfortably support the occipital portion even though the upper end 130 has a relatively steeper inclination, but the user may feel discomfort on his/her back portion supported by the lower end 140 of the body or pain in his/her waist portion in a case that the lower end 140 of the body is formed to have the steep inclination.

Hereinafter, referring to FIG. 5, an apparatus for assisting sleep according to another embodiment of the present disclosure will be described.

The apparatus for assisting sleep 100' according to another embodiment of the present disclosure may include all of the above-described configurations of the apparatus for assisting sleep 100 described above, and may further include a fixing unit configured to fix a human body.

Figure 5:
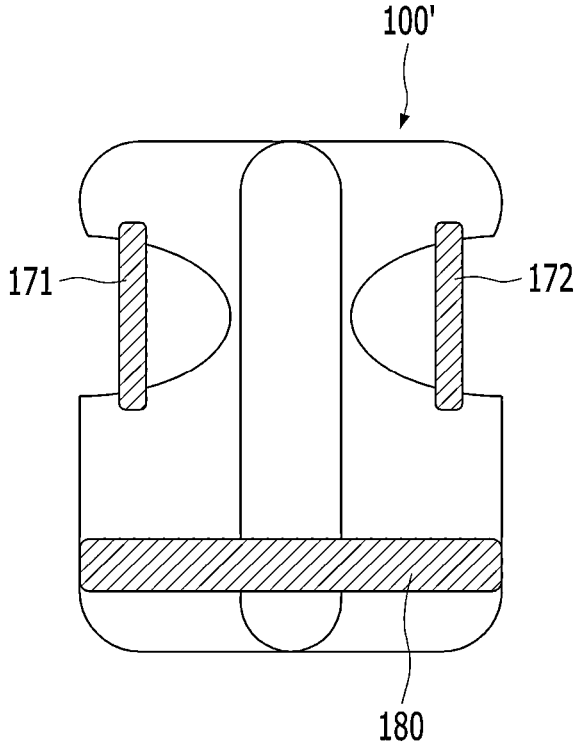
FIG. 5 is a top plan view illustrating an apparatus for assisting sleep according to another embodiment of the present disclosure.
Figure 6A:
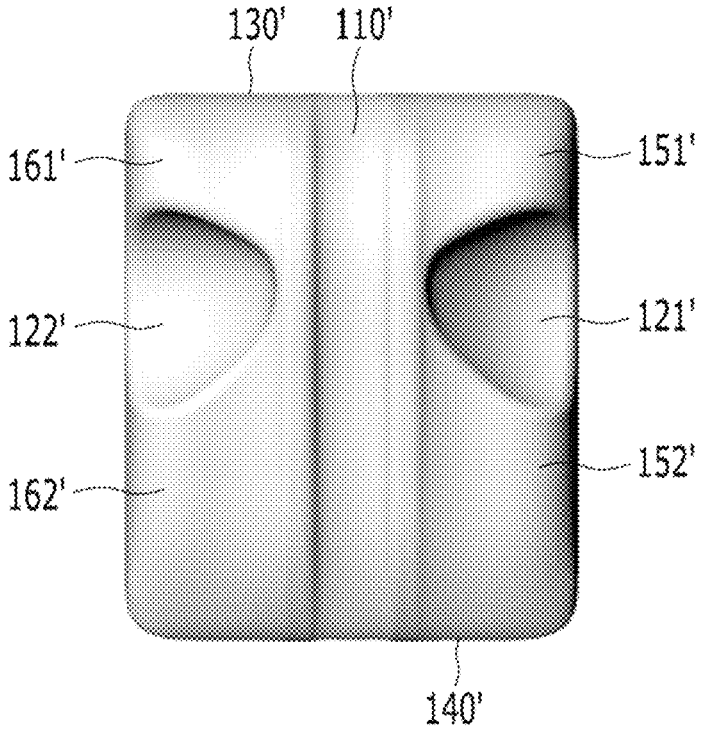
FIGS. 6*a* to 6*e* and 7*a* to 7*e* are exemplified views illustrating specific examples of the apparatus for assisting sleep according to the embodiment of the present disclosure.
Figure 6B:
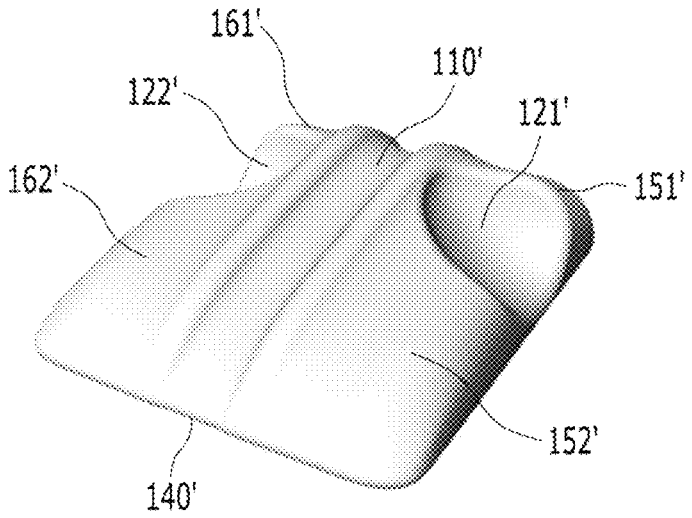
Figure 6C:
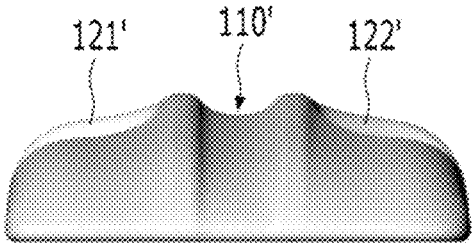
Figure 6D:
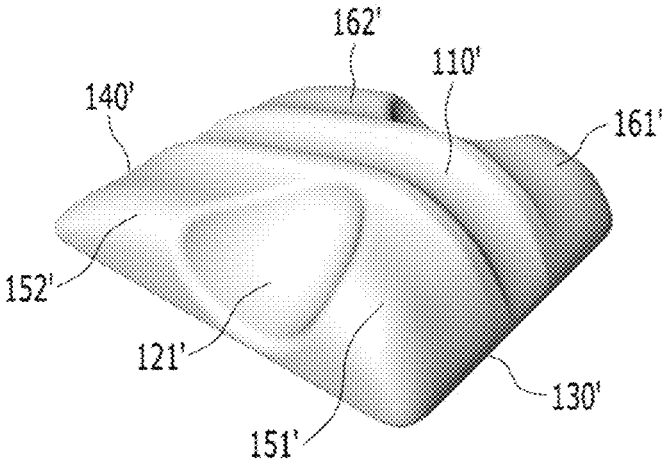
Figure 6E:
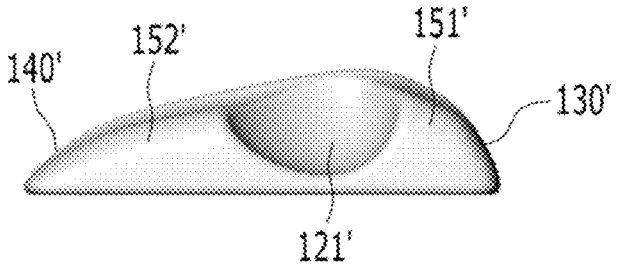
Figure 7A:
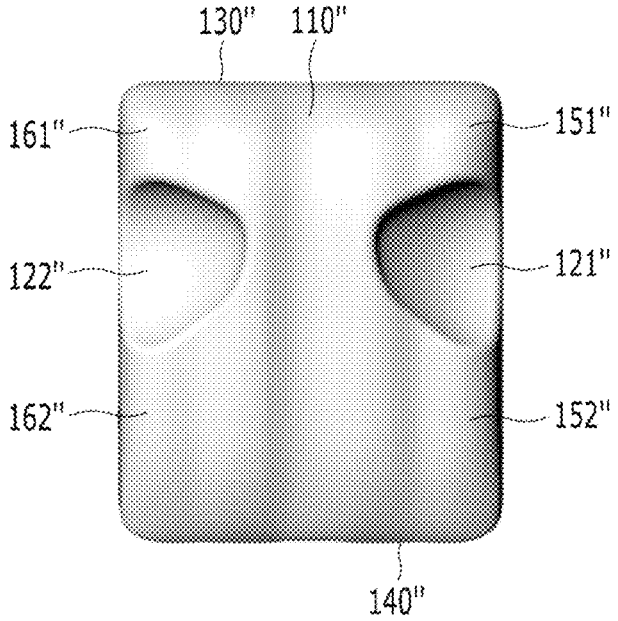
Figure 7B:
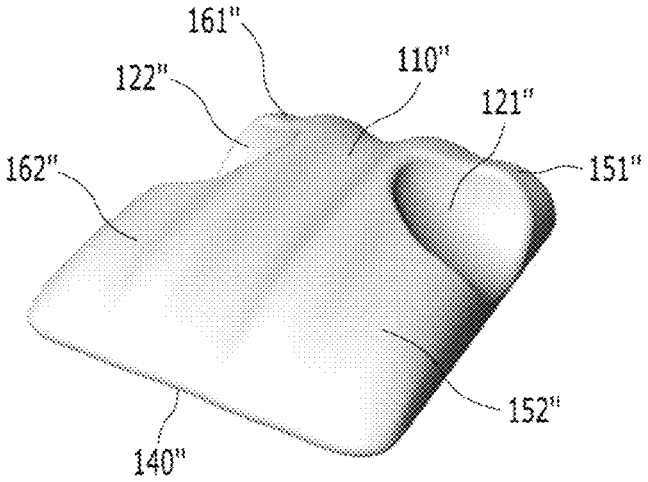
Figure 7C:
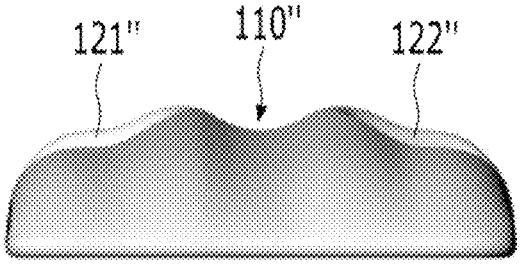
Figure 7D:
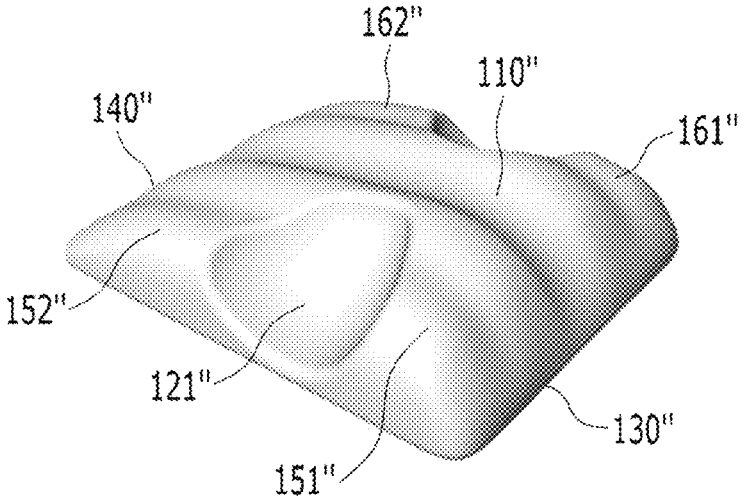
Figure 7E:
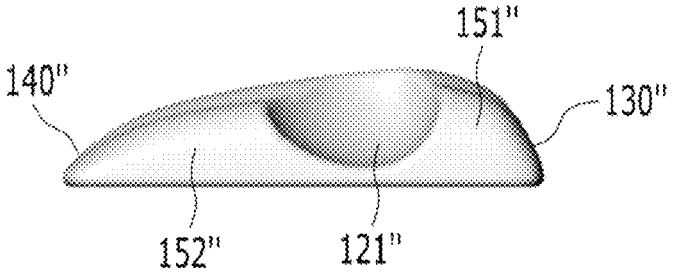

For example, as illustrated in FIG. 5, the apparatus for assisting sleep 100' may further include a fixing unit configured to fix a human body and formed around the plurality of accommodation grooves or the lower end of the body.

Here, the fixing unit may be formed in a shape of a plurality of shoulder fixing units 171 and 172 which is formed in a shape similar to a shoulder strap, and allow the user to put on the apparatus for assisting sleep 100' like a bag. In addition, the fixing unit may be formed in a shape of a waist fixing unit 180 which is formed in a shape similar to a waist strap, and allow the user to perform a fixing operation by wearing the waist fixing unit 180 like a waistband. Meanwhile, the fixing unit may also be configured in a shape that includes both the plurality of shoulder fixing units 171 and 172 and the waist fixing unit 180, and allow the user to perform more firmly the fixing operation onto the human body.

The fixing unit may prevent a desired body support portion of the apparatus for assisting sleep from being misaligned with an actual body support portion caused by moving while sleeping.

On the basis of adding the fixing unit, the present disclosure may provide a new paradigm of "pillow on the back", which is radically different from the conventional "pillow on the head".

Meanwhile, although the present disclosure has been basically described from a point of view of the apparatus assisting sleep 100 and 100', in addition to the apparatus for assisting sleep, it may be applied to various devices for supporting or correcting the human body. For example, the present disclosure may also be applied to a general apparatus for correcting a posture encompassing a sleep situation. The apparatus for correcting a posture may be utilized in the sleep situation, daily life, a treatment situation, and the like.

The apparatus for correcting a posture may include all of the above-described technical features related to the apparatus for assisting sleep 100 and 100' (e.g., technical features related to the body, the central groove, the plurality of accommodation grooves, the fixing unit, the wing portions, and the like).

Hereinafter, referring to FIGS. 6*a* to 7*e*, specific examples of the apparatus for assisting sleep according to the embodiment of the present disclosure will be described.

FIGS. 6*a*-6*e* and 7*a*-7*e* are exemplified views illustrating specific examples of a three-dimensional shape of the apparatus for assisting sleep according to the embodiment of the present disclosure.

Referring to FIGS. 6*a* to 6*e*, an exemplary product rendered as a three-dimensional image is illustrated to implement the configurations described above: a central groove 110', a first accommodation groove 121', a second accommodation groove 122', an upper end 130', a lower end 140', a first-first wing portion 151', a first-second wing portion 152', a second-first wing portion 161', and a second-second wing portion 162' and the like.

Referring to FIGS. 7*a* to 7*e*, an exemplary product including grooves having curved surfaces which is gentler than the product illustrated in FIGS. 6*a* to 6*e* may be illustrated. The exemplary product illustrated in FIGS. 7*a* to 7*e* also may implement the configurations described above: a central groove 110", a first accommodation groove 121", a second accommodation groove 122", an upper end 130", a lower end 140", a first-first wing portion 151", a first-second wing portion 152", a second-first wing portion 161", and a second-second wing portion 162".

The embodiments of the present disclosure described above are disclosed for illustrative purposes and the present disclosure is not limited thereby. In addition, the exemplary embodiments of the present disclosure described above may be variously modified, changed, and altered within the spirit and scope of the present disclosure by those skilled in the art to which the present disclosure pertains, and the modifications, changes, and alterations belong to the range of the present disclosure.

What is claimed is:

1. An apparatus for assisting sleep comprising:

a body;

a central groove formed in a center of the body and extending in a first direction; and a plurality of accommodation grooves formed in a symmetrical shape with respect to the central groove and arranged in a second direction perpendicular to the first direction, wherein the plurality of accommodation grooves is disposed closer to an upper end of the body than a lower end of the body, wherein each of the plurality of accommodation grooves includes a groove shape whose depth gradually changes, wherein the apparatus for assisting sleep comprising:

a first wing portion formed in an upper portion of an accommodation groove configured to support a lateral surface of a head or face which is a portion above a shoulder of a human body; and a second wing portion formed in a lower portion of the accommodation groove configured to support a flank or an arm which is a portion below the shoulder of the human body, wherein the first wing portion is configured in a shape that includes a narrower region than the second wing portion, wherein the first wing portion has an inclination that gradually decreases in height toward the upper end of the body, wherein the second wing portion has an inclination that gradually decreases in height toward the lower end of the body, wherein each of the plurality of accommodation grooves is located at an apex of a curve forming a contour of the apparatus in the side view, wherein the first wing portion is narrower along the first direction than the second wing portion, wherein the apparatus is configured to relieve pain by preventing shoulder compressing symptoms or neck clenching symptoms when a user moves to lie on the user's side while using the apparatus.

2. The apparatus of claim 1, wherein the central groove has a shape which is capable of accommodating a spine therein, and the plurality of accommodation grooves are each have a shape capable of accommodating the shoulder therein.

3. The apparatus of claim 1, further comprising:

a fixing unit formed around the plurality of accommodation grooves or the lower end of the body and configured to fix the human body.

4. The apparatus of claim 1, wherein a length of the body along the first direction corresponds to an average length between an occipital portion and a twelfth rib of an adult.

5. The apparatus of claim 1, wherein the body has inclinations which are decreased in height at the upper end and the lower end of the body, respectively, and the inclination of the lower end of the body is less than the inclination of the upper end of the body.

6. The apparatus of claim 1, wherein the plurality of accommodation grooves further comprises a first accommodation groove configured to accommodate one shoulder of the human body therein; and a second accommodation groove configured to accommodate the other shoulder of the human body therein, and wherein the apparatus further comprises:

a first-first wing portion formed on an upper portion of the first accommodation groove;

a first-second wing portion formed in a lower portion of the first accommodation groove;

a second-first wing portion formed in an upper portion of the second accommodation groove; and a second-second wing portion formed in a lower portion of the second accommodation groove, wherein each of the first-first wing portion and the second-first wing portion corresponds to the first wing portion, wherein each of the first-second wing portion and the second-second wing portion corresponds to the second wing portion.

7. The apparatus of claim 6, wherein the first-first wing portion comprises a narrower region than the first-second wing portion, the second-first wing portion comprises a narrower region than the second-second wing portion, the first-first wing portion is formed in a symmetrical shape with the second-first wing portion with respect to the central groove, and the first-second wing portion is formed in a symmetrical shape with the second-second wing portion with respect to the central groove.

8. An apparatus for correcting a posture comprising:

a body;

a central groove formed in a center of the body and configured to accommodate at least a part of a spine therein;

a plurality of accommodation grooves formed in a symmetrical shape with respect to the central groove and configured to accommodate both shoulders therein; and a fixing unit formed around the plurality of accommodation grooves or a lower end of the body and configured to fix a human body, wherein each of the plurality of accommodation grooves includes a groove shape whose depth gradually changes, wherein the apparatus for assisting sleep comprising:

a first wing portion formed in an upper portion of an accommodation groove configured to support a lateral surface of a head or a face which is a portion above a shoulder of a human body; and a second wing portion formed in a lower portion of the accommodation groove configured to support a flank or an arm which is a portion below the shoulder the human body, wherein the first wing portion is configured in a shape that includes a narrower region than the second wing portion, wherein the first wing portion has an inclination that gradually decreases in height toward the upper end of the body, wherein the second wing portion has an inclination that gradually decreases in height toward the lower end of the body, wherein each of the plurality of accommodation grooves is located at an apex of a curve forming a contour of the apparatus in the side view, wherein the first wing portion is narrower along the first direction than the second wing portion, wherein the apparatus is configured to relieve pain by preventing shoulder compressing symptoms or neck clenching symptoms when a user moves to lie on the user's side while using the apparatus.

* * * * *